United States Patent [19]

Green

[11] 4,202,572

[45] May 13, 1980

[54] LATCH FOR ESCAPE DOOR

[76] Inventor: William M. Green, 27830 Orchard Lake Rd., Farmington, Mich. 48024

[21] Appl. No.: 898,815

[22] Filed: Apr. 24, 1978

[51] Int. Cl.[2] ..... E05C 7/00

[52] U.S. Cl. ..... 292/217; 292/48; 296/187

[58] Field of Search ..... 292/217, 223, 226, 227, 292/200, 196, 221, 48; 296/23 G, 28 M

[56] References Cited

U.S. PATENT DOCUMENTS

| | | | |
|---|---|---|---|
| 1,339,492 | 5/1920 | Belden | 292/221 |
| 2,144,737 | 1/1939 | McCabe | 292/227 |
| 2,190,080 | 2/1940 | Ott | 292/227 X |
| 2,893,772 | 7/1959 | Edwards | 292/223 |
| 3,113,352 | 12/1963 | Gibbs et al. | 292/201 X |
| 3,992,052 | 11/1976 | Green | 296/28 M |

FOREIGN PATENT DOCUMENTS

| | | | |
|---|---|---|---|
| 1222294 | 6/1960 | France | 292/223 |
| 793975 | 4/1958 | United Kingdom | 292/196 |

*Primary Examiner*—J. Franklin Foss

*Attorney, Agent, or Firm*—Harness, Dickey & Pierce

[57] ABSTRACT

A latch particularly adapted to releasably secure an escape door has a rotating catch pivotally connected to a toggle joint link mechanism having an actuating arm and a stop means associated therewith. When the catch is in closed position, the link mechanism is located on the stop means side of its longitudinal axis and force in an opening direction on the catch is resisted by the stop means. The catch is released by pushing the actuating arm to thereby shift the link mechanism to the other side of its longitudinal axis where the link mechanism has sufficient movement to allow the catch to rotatably release.

1 Claim, 4 Drawing Figures

LATCH FOR ESCAPE DOOR

BACKGROUND AND SUMMARY OF THE INVENTION

The present invention relates to the field of latches for doors and the like and more particularly to quick release latches for escape doors or hatches such as are used in connection with trailers and mobile homes.

The need for an emergency exit for a trailer or mobile home can be tragically apparent and can arise from natural forces such as fire or from threat of assault or robbery by another person. An escape door responding to this need has been previously patented by the present inventor in U.S. Pat. No. 3,992,052 which issued Nov. 16, 1976 for an "Escape Door for Trailer". In one aspect, the present invention relates to a quick release latch especially suitable for use in an escape door like that previously patented by the present inventor. For maximum safety such doors require latches which are simply and quickly operated yet which are effective to resist opening by any person on the outside. In short, safety with respect to these kinds of escape doors, and latches therefor, involves the dual consideration of easy exit for the trailer occupant but difficult entry for any undesired person.

It is one object of the present invention to provide a latch for escape doors and the like which facilitates easy and direct exit therefrom. Another object of this invention is to provide a latch which is secure from opening by someone from the outside. Yet another object of this invention is to provide a latch for a spring loaded door wherein the force of the spring outwardly urging the door, tends to maintain the latch in a closed, or latching position.

These and other objects are achieved by the latch of the present invention which has a rotating catch pivotally secured to a toggle joint linking mechanism having first and second links, an actuating arm and a stop means on one side of the longitudinal axis of the linking mechanism. In the closed position, the toggle joint linking mechanism is located on the stop means side of its longitudinal axis so that force on the catch in an opening direction is resisted by said stop means. The catch is released by pushing the actuating arm to adjust the location of the linking mechanism to the other side of its longitudinal axis which allows sufficient movement to release the catch.

DESCRIPTION OF THE INVENTION

Figure 1:
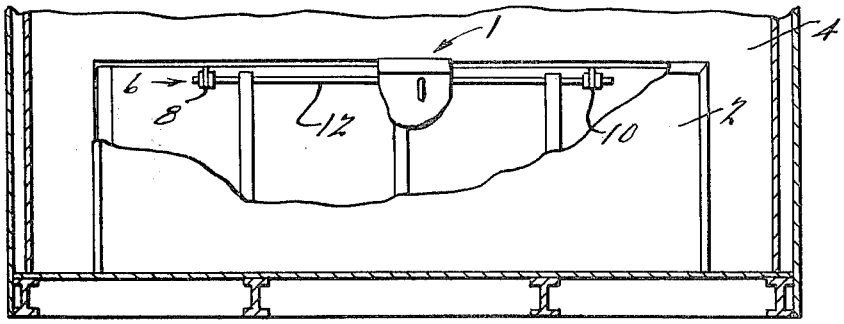
FIG. 1 is an interior view, broken away, of an escape door in a rear wall of a trailer having a latch of the present invention.

Now referring to the drawing, FIG. 1 illustrates a latch, generally indicated by the numeral 1, in operative association with an escape door 2 located in end wall 4 of a trailer. A latch mechanism 6 is mounted along the underside of the upper edge of door 2 and has catches 8 and 10 which are engaged and disengaged by rotary movement of shaft 12 which is controlled by latch 1. It will be appreciated, however, that latch 1 can be operated independent of other latching mechanisms and such independent uses are contemplated by the present invention. It will, of course, also be readily apparent that the advantages of the present invention are such that it is readily adaptable to be used with doors or hatches other than escape doors for trailers and such other uses are also intended to be within the broad scope of the present invention.

Figure 2:
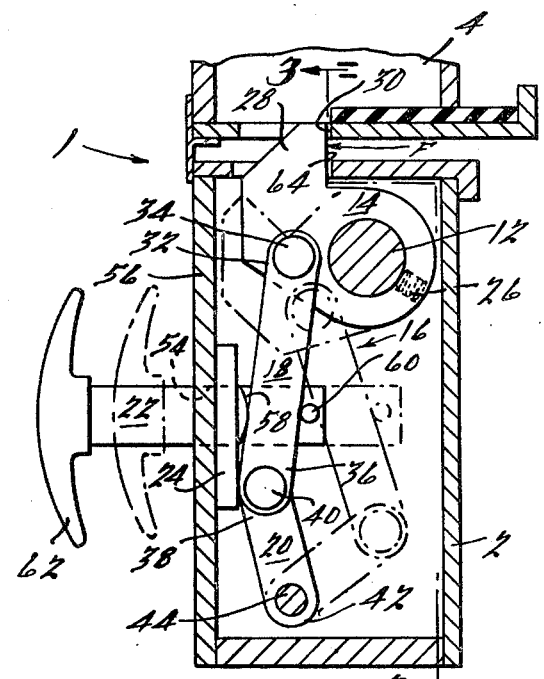
FIG. 2 is an enlarged cross-sectional view of the structure of FIG. 1 and illustrating a latch mechanism of the present invention.
Figure 3:
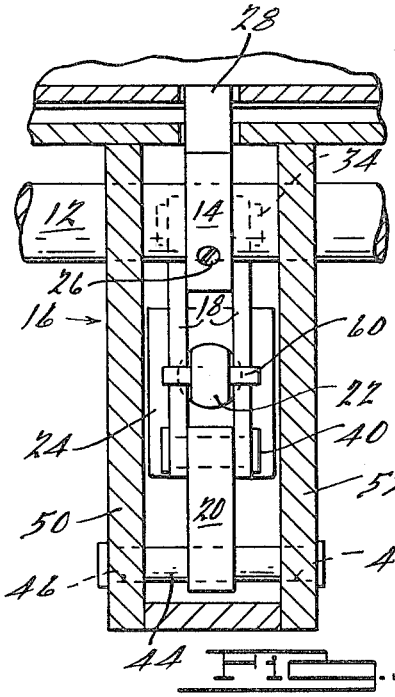
FIG. 3 is a front sectional view taken substantially along the line 3—3 of FIG. 2.
Figure 4:
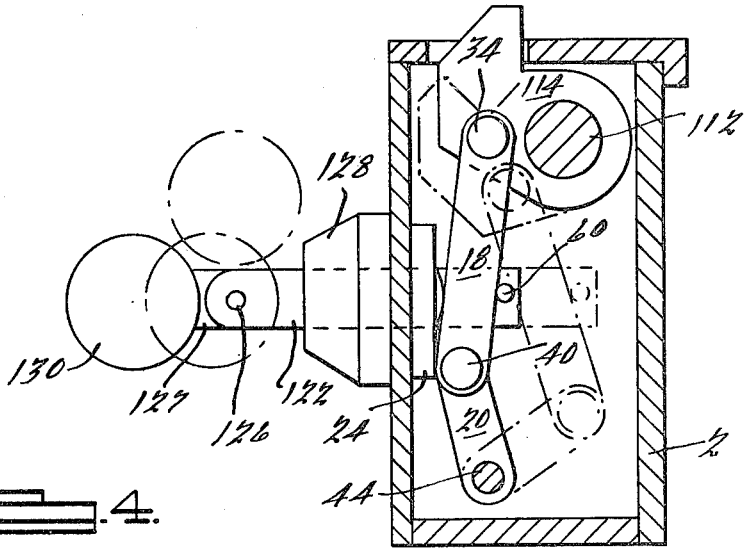
FIG. 4 is a cross-sectional view of an alternative embodiment of the latch mechanism of the present invention.

In general, latch 1 comprises catch 14 which is adapted to pivot about the longitudinal axis of shaft 12 and which is pivotally connected to a toggle linkage 16 having bifurcated link 18, lower link 20 and operating arm 22. As shown best in FIG. 2, stop plate 24 provides a limit to leftward movement of the toggle linkage. Catch 14 can be secured to shaft 12 by a set screw 16. Optionally, where no other catches are operationally dependent upon the rotation of shaft 12, catch 14 can be free to rotate about shaft 12 as shown in FIG. 4. Upwardly extending from catch 14, and integrally formed therewith, is latch finger 28 which is adapted to abut against edge 30 of wall 4 thereby preventing outward movement of door 2. Catch 14 is pivotally attached to the upward end 32 of bifurcated link 18 by pin 34. The lower end 36 of bifurcated link 18 is pivotally connected to the upper end 38 of lower link 20 by pin 40. Lower end 42 of lower link 20 is pivotally located by a pin 44 whose ends are fixedly located in bores 46 and 48 in left side wall 50 and right side wall 52 respectively of latch 1. The pivotal connection of bifurcated link 18 and lower link 20 at pin 40 is located either left or right of a line drawn through the center of pins 34 and 44 by means of operating arm 22 which is slidably located in bore 54 in front face 56 and stop plate 24 which is fixedly attached to front face 56 and provides a bore 54 having sufficient length to longitudinally guide operating arm 22 therein. As shown in FIG. 2, operating arm 22 has a shoulder 58 abutting against the left edge of bifurcated arm 18 so that rightward movement of operating arm 22 causes rightward movement of toggle linkage 16. Operating arm 22 also has a pin 60 in abutting relationship to the right edge of bifurcated link 18 so that leftward movement of operating arm 22 causes leftward movement of toggle linkage 16. Leftward movement of toggle linkage 16 is limited by bifurcated link 18 contacting stop plate 24. Rightward movement of toggle linkage 16 is limited by handle 62 of operating arm 22 abutting against front face 56. Other suitable stop means will, of course, be apparent to those skilled in the art.

FIG. 4 illustrates an alternative embodiment of the present invention wherein catch 114 pivots about shaft 112 and wherein operating arm 122 has an extension 127 connected thereto by pin 126 which is adapted to pivot 90° between a horizontal and vertical position. When in the vertical position, operating arm 122 is prevented from rightward movement because such movement is opposed by extension 124 abutting against front face extension plate 128. Thus accidental release of catch 114 is prevented. The end of extension 124 can have a ball handle 130.

The operation of the latch 1 of the present invention can best be understood by reference to FIG. 2 where latch 1 is shown by full lines in a closed or locked position and by broken lines in an open or unlocked position. In the locked position bifurcated link 18 is at its most leftward position where force F acting against right face 64 of latch finger 28 tends to cause counterclockwise rotation of catch 14 about the longitudinal axis of shaft 12 and a generally downward force at pin 34. This downward force has a vertical component along bifurcated link 18 and lower link 20 opposed by fixed pin 44 and a lateral component leftward opposed by stop plate 24. Thus, force F tends to maintain catch 14 in a closed position. Thus, door 2 can be outwardly spring-loaded so that when latch 1 is released door 2 will automatically open and yet when door 2 is closed, the force of the spring will tend to maintain latch 1 in a closed position. Furthermore, even if force F is great, the lateral, leftward component of the force will be small and one which can be easily overcome by pushing operating arm 22 rightward thereby opening latch 1. Rightward movement of toggle linkage 16 communicates a downward force on pin 34 and, in consequence, causes a counterclockwise rotation of catch 14 about the longitudinal axis of shaft 12 thereby releasing latch finger 28 and allowing door 2 to open outwardly.

While a specific embodiment of this invention has been described and illustrated herein, it is to be understood that the invention may be varied within the scope of the appended claims without departing from the spirit of the invention.

What is claimed is:

1. A latch assembly particularly adapted for escape doors and the like, comprising, a catch member, means supporting said catch member for rotating movement about a first axis between a locking position and an unlocking position, a toggle linkage for causing said catch member to be moved between said positions and comprising first and second linkage members arranged in generally end-to-end relationship, first pivot means pivotably connecting the respective confronting end portions of said linkage members to one another, second pivot means pivotably connecting one end of said first linkage member to said catch member, third pivot means pivotably connecting one end of said second linkage member, said first, second and third pivot means defining pivotal axes arranged parallel to one another and parallel to said first axis, said second and third pivot means being located along a common imaginary plane arranged generally parallel to said first and pivotal axis, an operating arm arranged at a generally right angle to said imaginary plane and connected to said toggle linkage, said operating arm being linearly reciprocably movable solely under the influence of a manual force applied thereto between a first extended position wherein said toggle linkage members are disposed in a first over-center position with first pivot means being located on one side of said imaginary plane and said catch member disposed in said locking position, and a second retracted position wherein said toggle linkage members are disposed in a second over-center position with said first pivot means being located on the opposite side of said imaginary plane and said catch member disposed in said unlocking position, said operating arm being the sole means for causing said toggle linkage members to move between said first extended position and said second retracted position.

* * * * *